US006283469B1

(12) United States Patent
Weber

(10) Patent No.: US 6,283,469 B1
(45) Date of Patent: Sep. 4, 2001

(54) DEVICE AND METHOD FOR PROVIDING A SUPPLY OF SINGLE SHEETS OF DIFFERENT THICKNESS

(75) Inventor: Thomas Weber, Munich (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/422,427

(22) Filed: Oct. 21, 1999

(30) Foreign Application Priority Data

Mar. 2, 1999 (DE) ..... 299 03 717

(51) Int. Cl.[7] ..... B65H 1/08
(52) U.S. Cl. ..... 271/148; 271/160
(58) Field of Search ..... 271/148, 160, 271/161, 126

(56) References Cited

U.S. PATENT DOCUMENTS 1,490,070 * 4/1924 Korth ..... 271/148
3,720,407 * 3/1973 Woodward ..... 271/148
4,942,435 7/1990 Kniesel et al. .
5,364,087 * 11/1994 Schieck et al. ..... 271/148
6,039,315 * 3/2000 Lim ..... 271/127

FOREIGN PATENT DOCUMENTS 532 292 8/1931 (DE) .
27 12 571 C3 8/1981 (DE) .
26 17 334 C2 12/1988 (DE) .
93 00 292. U 4/1993 (DE) .
689 16 353 T2 2/1995 (DE) .
WO 98/18051 4/1998 (WO) .
WO 98/18054 4/1998 (WO) .

* cited by examiner

*Primary Examiner*—H. Grant Skaggs
(74) *Attorney, Agent, or Firm*—Schiff Hardin & Waite

(57) ABSTRACT

A device and method for providing a supply of single sheets wherein each single sheet has a varying thickness. The present invention includes a stack of single sheets that are supported on a lifting platform. The lifting platform includes a compensation device for leveling the stack by compensating for the varying thickness of each single sheet.

15 Claims, 5 Drawing Sheets

DEVICE AND METHOD FOR PROVIDING A SUPPLY OF SINGLE SHEETS OF DIFFERENT THICKNESS

BACKGROUND OF THE INVENTION

The invention relates to a device and a method for providing a supply of single sheets, and particularly for its utilization in a printer or copier.

FIELD OF THE INVENTION

Applications for printers or copiers or the like exist for providing a supply of single sheets, such as single sheets of paper, wherein the thickness of a single sheet varies. For example, when a strip-shaped and preprinted stick-on label is applied to a single sheet, the thickness considerably increases in the area where the stick-on label is applied. Generally, the single sheets are rectangular, wherein the stick-on labels include a strip extending in the direction of the sheet width. As a result, the increased thickness makes it difficult to remove an individual single sheet from the stack during the application of providing the supply of single sheets.

An example of this difficulty exists during printing operations that require the single sheets to be removed along the direction of the sheet width for increased throughput of the single sheets. In this case, the longitudinal edge of the uppermost single sheet in the stack has a visible bend due to the varying thickness across the single sheets. As a result of this bend, the throughput of single sheets may decrease because of a paper jam or because single sheets are not individually dispensed from the stack.

U.S. Pat. No. 4,942,435 discloses a device for providing a supply of single sheets wherein the single sheets have a greater thickness at one side due to a mylar strip for supporting margin perforations. The uppermost single sheet is removed from the stack in a lengthwise direction during printer operations. This device further includes a compensation device that has two movable plates. These plates are flexibly connected to one another wherein one plate is rigidly supported and the other block is supported by springs. The movable plates are aligned for positioning the uppermost single sheet in a flat or planar position from which it can be easily removed along its lengthwise direction. The device further discloses that the movable plates can be replaced by stationary plates for positioning the uppermost single sheet.

German Patent Document DE-A-26 17 334 discloses an insertion device for a pre-folded continuous stock web. The insertion device includes compensation elements for positioning the uppermost single sheet of the paper stack in an optimally planar position.

German Patent Document DE-A-27 12 571 discloses a depositing device for a pre-folded continuous stock web in a forms stacker. This device includes a movable plate that upwardly supports the stack of single sheets so that the uppermost sheet is optimally positioned in a planar or flat position. Each of the single sheets has a varying thickness due to a margin region.

International Patent Documents WO-A-98/18051 and WO-A-98/18054 have the same applicant as the present invention. These patent documents disclose output devices for single sheets. The output devices include single sheets that form of a stack. The single sheets are removed and fed into a printer or copier device.

German Patent Document DE-UI 93 00 292.0 discloses a magazine for storing flat articles made of paper, such as photo sleeves. The magazine has two areas. The first area includes those parts of the photo sleeves that are a single-layer wherein the second area includes parts of the photo sleeves that are in two-layers. The two areas include supporting surfaces that are mechanically decoupled from each other. The stack regions of varying thickness are positioned at different levels as a result thereof.

German Patent Document DE LP 532 292 discloses a stack table of a suction pump sheet feeder for printers wherein a plurality of seating boards are adjustable in height. As a result, the positions of the print sheets can be adapted to a suction rod with respect to different suction points in order to achieve improved suction properties.

SUMMARY OF THE INVENTION

An object of the present invention is to provide a device and method for providing a supply of single sheets that is operationally reliable for removing or dispensing single sheets from a stack of single sheets, wherein each of the single sheets has a varying thickness.

An object of the present invention is to optimally position all uppermost single sheet of the stack in a planar or flat position.

An object of the invention is to increase the throughput results of the single sheets within a printer, a copier or the like wherein the single sheets are dispensed along a direction of a sheet width.

A further object of the invention is to provide a device of simple construction that is easily incorporated within presently existing paper supply applications, such as printer and copier applications.

DESCRIPTION OF THE PREFERRED EMBODIMENTS

Figure 5:
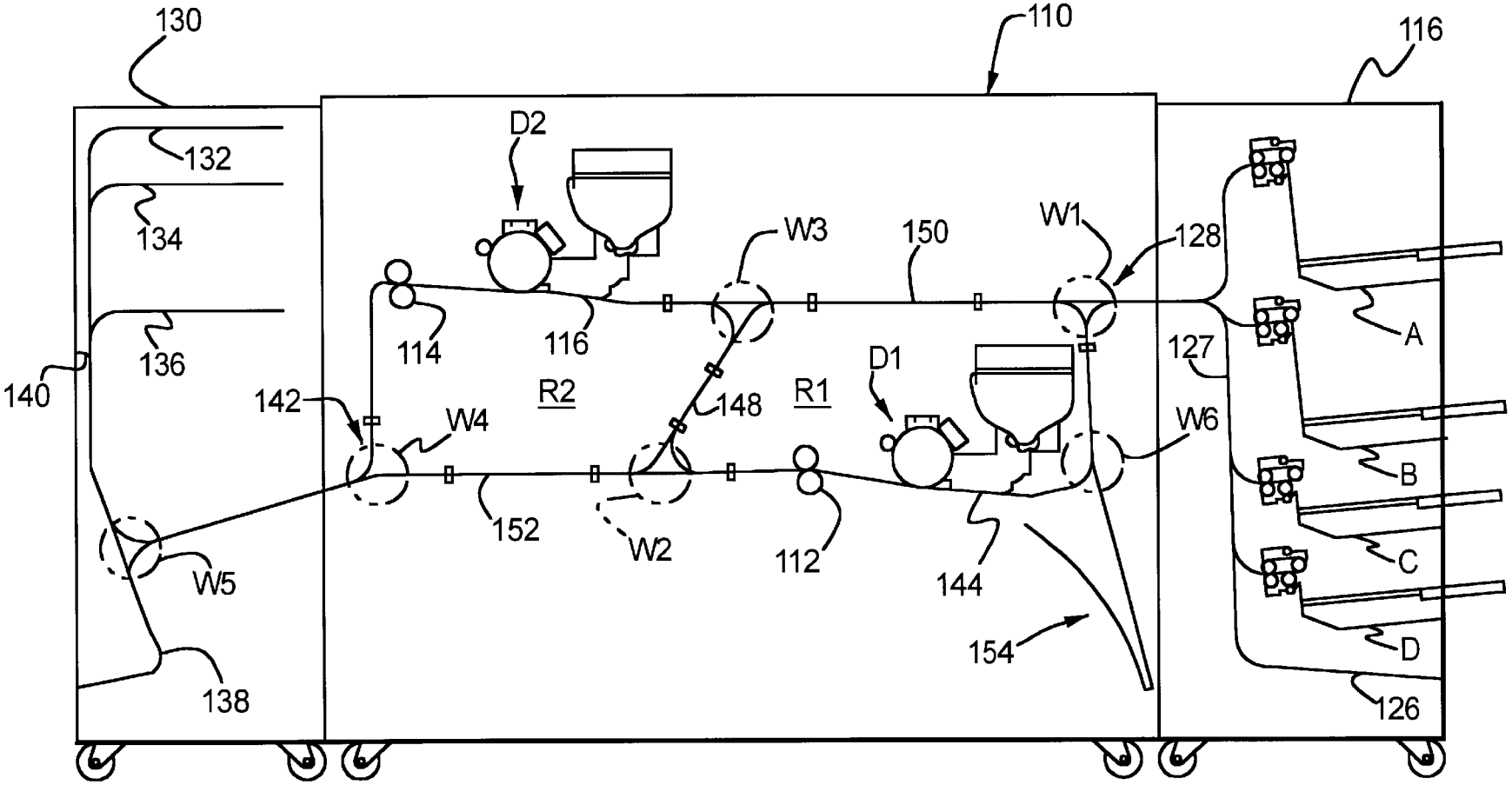
FIG. 5 shows a schematic view of a high performance printer.
Figure 6:
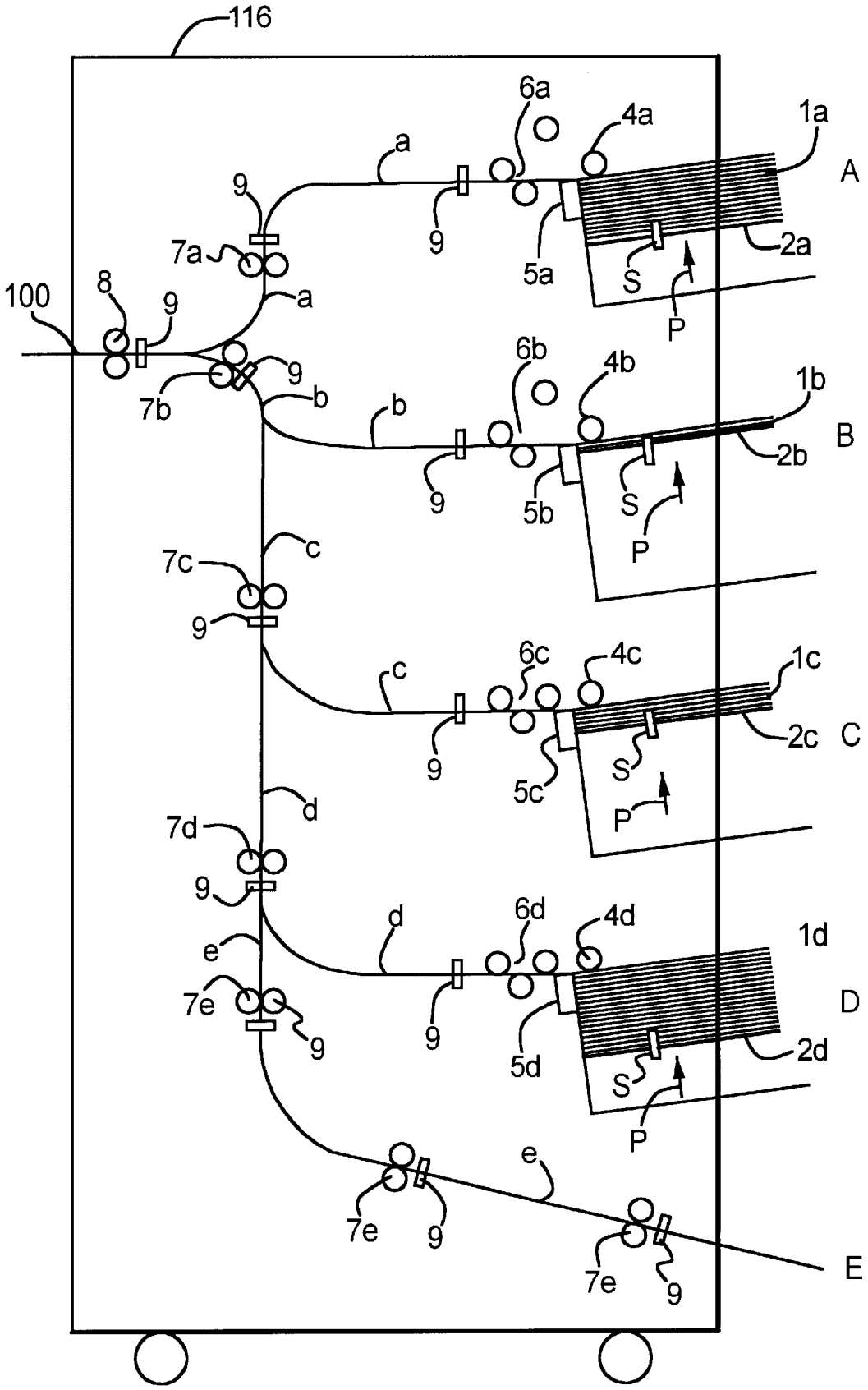
FIG. 6 shows a schematic view of a paper input device.

The printer shown in FIG. 5 and the input device described in FIG. 6 are described in International Patent Documents WO-A-98/18051 and in WO-A-98/18054.

Figure 1:
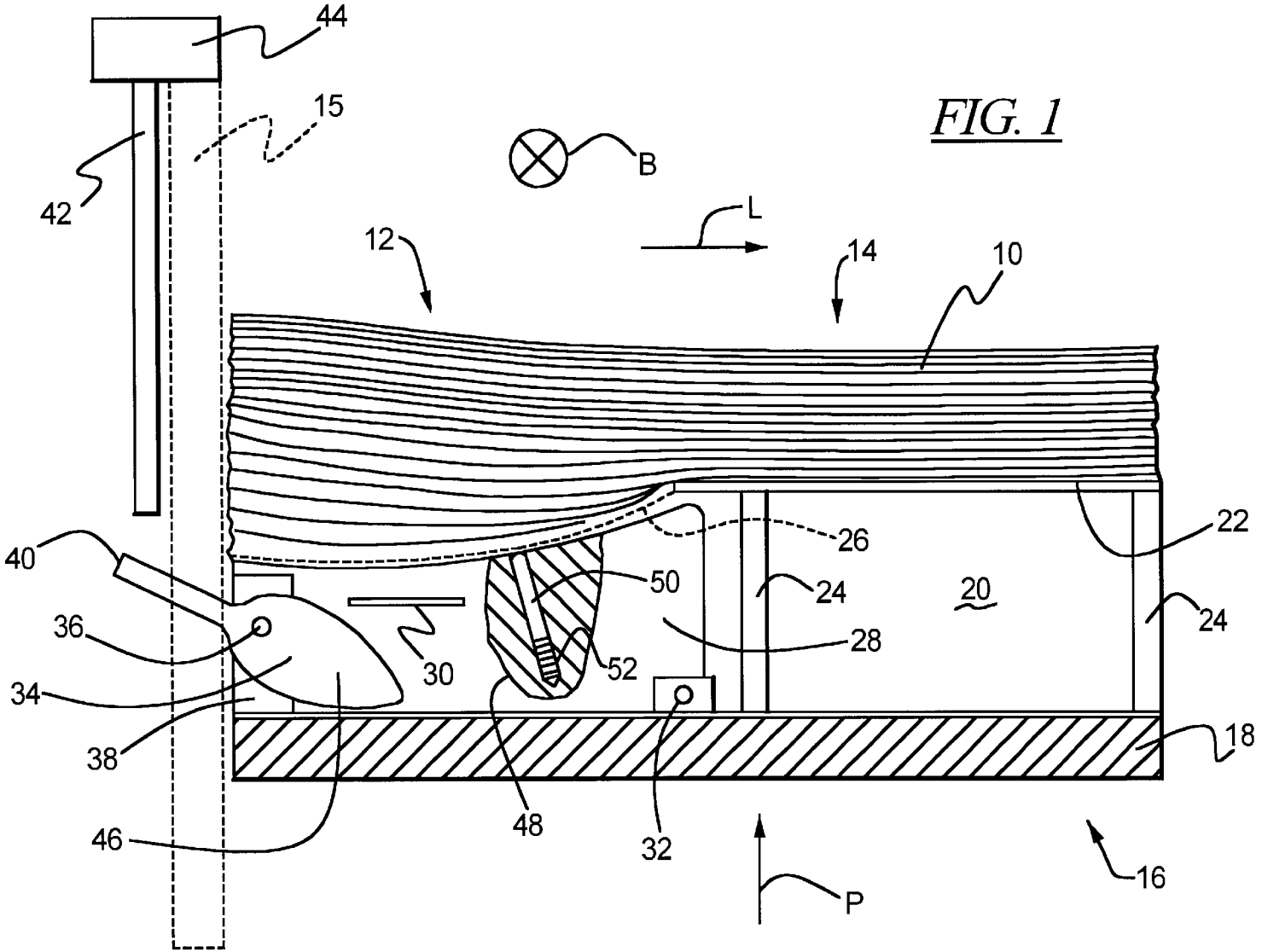
FIG. 1 shows a side sectional view of a paper supply device.
Figure 2:
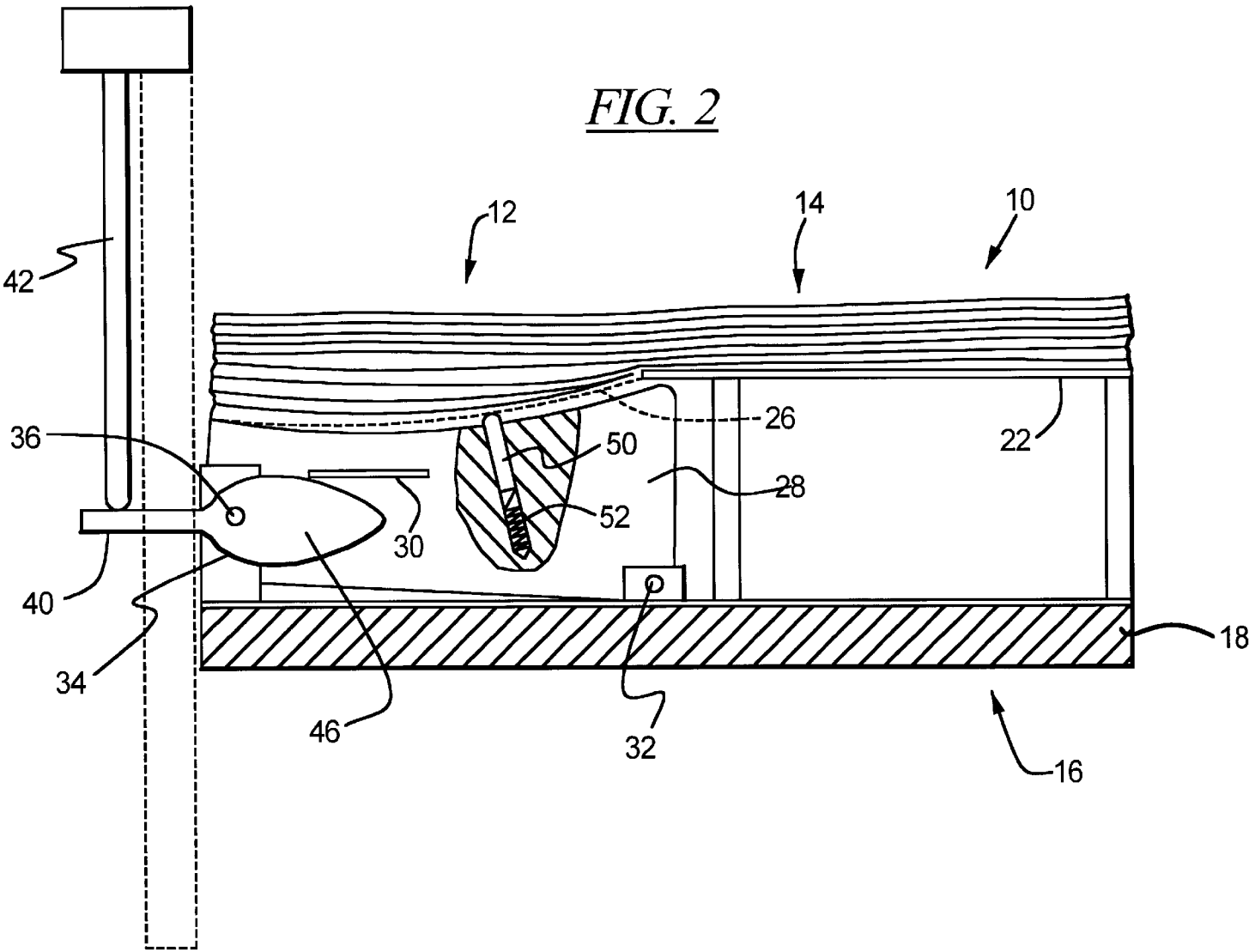
FIG. 2 shows a side sectional view paper supply device with a lifted compensation element.

FIG. 5 shows a high performance printer 110 for fast printing of single sheets of paper. The high performance printer 110 contains a first lower printing unit D1 and a central upper printing unit D2. According to the known electro-graphic method, both printing units D1 and D2, work at the same transfer printing speed. Fixing mechanisms, which are schematically indicated in FIG. 1 by two pairs of rollers 112 and 114, follow the printing units D1 and D2. A paper input 116 is connected to the performance printer The paper input 116 includes a number of paper input compartments A, B, C and D. Each compartment includes a supply of single sheets and an external paper input channel 126 in which single sheets can be supplied from the outside. Single sheets are supplied to an input section 128 via a conveying channel 127. At the output side, a paper output 130 is connected to the high performance printer 110. The paper output 130 contains a number of output receptacles 132, 134 and 136. In addition, two output channels 138 and 140 are provided through which single sheets are dispensed to further processing stations. The high performance printer 110 transfers the printed single sheets to the paper output 130 through the output section 142.

Conveying paths for conveying or transferring the single sheets are disposed within the high performance printer 110. These paths provide for a variety of different operating modes of the high performance printer. The transfer printing conveying paths 144 and 146 connect to the respective printing units D1 and D2. The conveying paths 144 and 146 have drives that adjust the transfer printing speed of each path to correspond with their respective printing units D1 and D2. In addition, the transfer paths 144 and 146 are interconnected by a connection channel 148. The conveying path of the first printing unit D1 also includes a ring R1 located by a supply channel 150. Single sheets can be supplied from the input section 128 to the second transfer conveying path 146 via the supply channel 150. Similarly, the conveying path for the second printing unit D2 includes a ring R2 located by a discharge channel 152. Single sheets that are printed by the printer D1 are supplied to the output section 142 via the ring R2.

A first shunt W1 is arranged between the input section 128, the first transfer printing conveying path 144 and the supply channel 150. The shunt W1 provides for single sheets from the input section 128 to be selectively supplied to the first transfer printing conveying path 144 or to the supply channel 150. Alternatively, single sheets transferred on the supply channel 150 in the direction of the shunt Wl are supplied to the first transfer printing conveying path 144.

Further, a second shunt W2 and a third shunt W3 are arranged at the ends of the connection channel 148 and respectively connect to the adjacent conveying paths 144, 148, 152 and 146, 148, 150. A fourth shunt W4 is situated in close proximity to the output section 142 and connects to the adjacent conveying paths. The paper output 130 includes a fifth shunt W5 that performs as a turnover device. The high performance printer further includes an ejection mechanism 154 for removing single sheets that are supplied to the ejection mechanism 154 via a shunt W6.

FIG. 6 shows the paper input 116 of FIG. 5 in greater detail. It has a number of input compartments A through D and an external feeder E. Stacks of single sheets of paper 1*a* through 1*d* are placed in their respective input compartments A through D. The paper stacks 1*a* through 1*d* are pushed upwardly along a direction P. As a result, the paper stacks are pushed against the sheet dispensing devices 4*a* through 4*d* by the lifter devices 2*a* through 2*d*. In addition, sensors 5*a* through 5*d* are connected to their respective input compartments A through D. The sensors 5*a* through 5*d* output a signal as soon as the respective compartments A through D are approximately empty of their respective paper stacks. Further, a sensor S is connected to the bottom of each compartments A through D. The sensor S outputs a signal when the respective compartment is also empty.

Single sheets are removed from each respective input compartment by a dispensing device 4*a* through 4*d* and then fed to a transfer mechanism 6*a* through 6*d* and 7*a* through 7*d*. Due to the transfer mechanism, the single sheets are then transferred on paths a through d and are finally accepted by an additional conveying mechanism 8. Subsequently, the sheets are transferred to a sheet transfer point 100 from which the sheets are transferred to a print mechanism and copy mechanism (not shown) by the paper output mechanism.

A supply of single sheets that is fed into the external feeder E are transferred via the conveying mechanism 7*e* along a conveying path e until they are accepted by the conveying mechanism 7*d* that is located at the end of the conveying path d. Light sensors 9 are provided at different locations along the conveying paths a through e for monitoring this transfer.

During an automatic sheet output, a single sheet, which was removed by the sheet dispensing device 4*a* from a sheet stack 1*a* of compartment A, is transferred along the conveying path by the conveying mechanism 6*a*, 7*a* and 8 to the sheet transfer point 100. Similarly, single sheets that were removed from the input compartments B, C and D are conveyed along the conveying path b through d via the conveying mechanism 6*b*, 7*b*, 8 and 6*c*, 7*c*, 7*b*, 8 and 6*d*, 7*d*, 7*c*, 7*b* and 8 to the sheet transfer point 100.

In relation to FIGS. 5 and 6, FIG. 1 shows the construction of a paper supply device that is utilized in a variety of different printer, copier or other like applications, such as the high performance printer application as illustrated in FIGS. 5 and 6. In this application, the paper supply device is located in one or a number of the input compartment of the high performance printer of FIGS. 5 and 6.

The paper supply device includes a stack 10 of rectangular single sheets. Each of the single sheets has longitudinal side that extends in the direction L1 and a latitudinal side that extends in direction L2. In relation to the high performance printer of FIGS. 5 and 6, the stack 10 corresponds to the stacks 1*a*, 1*b*, 1*c*, 1*d* in the compartments A, B, C, D of FIG. 6.

In addition, the single sheets of the stack 10 have a strip-shaped stick-on label that is located in a section or strip region 12. The stick-on label almost completely covers the single sheet in a latitudinal direction L2. The stick-on label has a constant thickness. As well as the strip region 12, each of the single sheets of the stack 10 has a section or non-strip region 14 in which the single sheet does not have a stick-on label. Therefore, the stack 10 is considerably thicker in the area or strip region 12 than in the area or non-strip region 14.

The stack 10 is supported by a lifting platform 16 that has a bottom plate 18. The stack 10 is further held in place by a paper width adjuster 15. The lifting platform 16 moves along a direction P in both an upward and downward direction. During printing, the height of the lifting platform 16 is adjusted such that the uppermost single sheet is pushed against the dispensing device, such as the dispensing device 4*a*, 4*b*, 4*c*, and 4*d* of the high performance printer 110 which removes the uppermost single sheet of the stack 10 in the latitudinal direction L2. On the other hand, the lifting platform 16 moves in the downward direction away from the dispensing device when the stack of single sheets is first placed or loaded on the lifting platform.

The lifting platform 16 further includes a compensation device 20 that is disposed between the bottom 18 and the stack 10 of single sheets. The compensation device 20 supports the lowermost single sheet of the stack 10 for positioning the height of the strip region 12 below the height of the non-strip region 14 that has a lesser height or thickness than the strip region 12. Thus, the uppermost single sheet is held approximately in a planar or flat position so that each single sheet of the stack is individually removed from the stack by the dispensing device.

The compensation device 20 further includes a stationary plate 22 that is rigidly connected to four supports 24 (FIG.

1 only shows two supports 24). The stationary plate 22 supports the non-strip region 14 of the single sheets. In section 12, the stack 10 is supported by a great number of lamellae 26 that extend in the direction L2. The lamellae are movably interconnected to form a movable plate. On both sides and at both ends, the lamellae 26 are supported by bearing legs 28 (only one can be seen in FIG. 1). The upper edge of the bearing legs 28 has a concavely arced surface that the lamellac 26 conform thereto. The bearing legs 28 are rigidly interconnected by a dog element 30 and are swivelled around a rotational axis 32. The compensation devices also includes a lever 34 that is rotatably mounted around a rotational axis 36. The rotational axis 36 includes a pintail that has a pillow block or bearing block 38. The pillow block 38 rests in a stationary position on the bottom plate 18 of the lifting platform 16.

The lever 34 further includes a first lever arm 40, whose end abuts against the end of a stationary detent 42 relative to the printer housing during an upward movement of the lifting platform 16. This detent 42 is adjustably mounted and is incorporated in a fastening block 44. The other end of the lever 34 includes an eccentric 46 and has a control surface at its upper side. The control surface engages the dog element 30 during an upward movement of the eccentric 46.

Turning to FIG. 1, a support element is connected to the bearing legs in section 48 and engages or supports a bottom side of the lamellae 26. The support element 50 includes a pressure spring 52 that acts to move the support element 50 upward.

Turning to FIGS. 2 through 6, the device shown in FIG. 1 operates to provide a supply of single sheets. As previously discussed, the paper supply device is utilized in a variety of different printer, copier or like applications. An exemplary example of the device is within the high performance printer 110. In this application, the supply device is provided in at least one of the input compartments A, B, C, D of the printer (FIGS. 5 and 6). The supply stacks 1*a*, 1*b*, 1*c*, 1*d* (FIG. 6) are thereby referred to as supply stack 10 in FIG. 1. The supply stacks 1*a*, 1*b*, 1*c*, 1*d*, move along P in an upward direction due to the lifting devices 2*a*, 2*b*, 2*c* and 2*d* that include the lifting platform as shown in FIG. 1. The lifting platform continually moves the supply stack 10 upward until it pushes against the dispensing device 4*a*, 4*b*, 4*c*, or 4*d* as the height of the stack decreases.

Returning to the FIGS. 2 and 3, the lever arm 40 of the lever 34 is impeded by the detent 42 during its upward movement in the direction P and rotates around a rotational axis 36. The detent 42 is thereby fixed to the device at the printer and at the respective input compartment A, B, C, D, and therefore does not move during the upward movement. As a result, during the upward movement in the direction P of the lever 40, the eccentric 46 moves upwardly. As a result, its upper, arced control surface pushes against the dog element 30 and pivots the bearing legs 28 around the rotational axis 32. Therefore, the lamellae 26, which at least partially rest on the upper edges of the bearing legs 28, move upward, so that the thickness in the area 12 of the stack 10 is compensated and so that the uppermost single sheet are positioned approximately in a planar or flat position. In addition, the support element 50, which is moved upward together with the bearing legs 28, lifts a part of the lamellae 26 upward as a result of the spring force of the spring 52. This movement results because the weight of the stack 10 in the section 12 is reduced when the stack height is decreased. When the stack weight is reduced, the support element 50 acts upon section 12 or the strip region due to the force exerted by the spring 52. The spring force 52 is transmitted to the strip region through the lamellae 26. The determined sag of the connected lamellae 26, that is determined by the arch of the upper edge of the bearing legs 28, is reduced as a result thereof. Due to the support element 50 action, the uppermost single sheet remains in a planar or flat position even as the stack height decreases.

Figure 3:
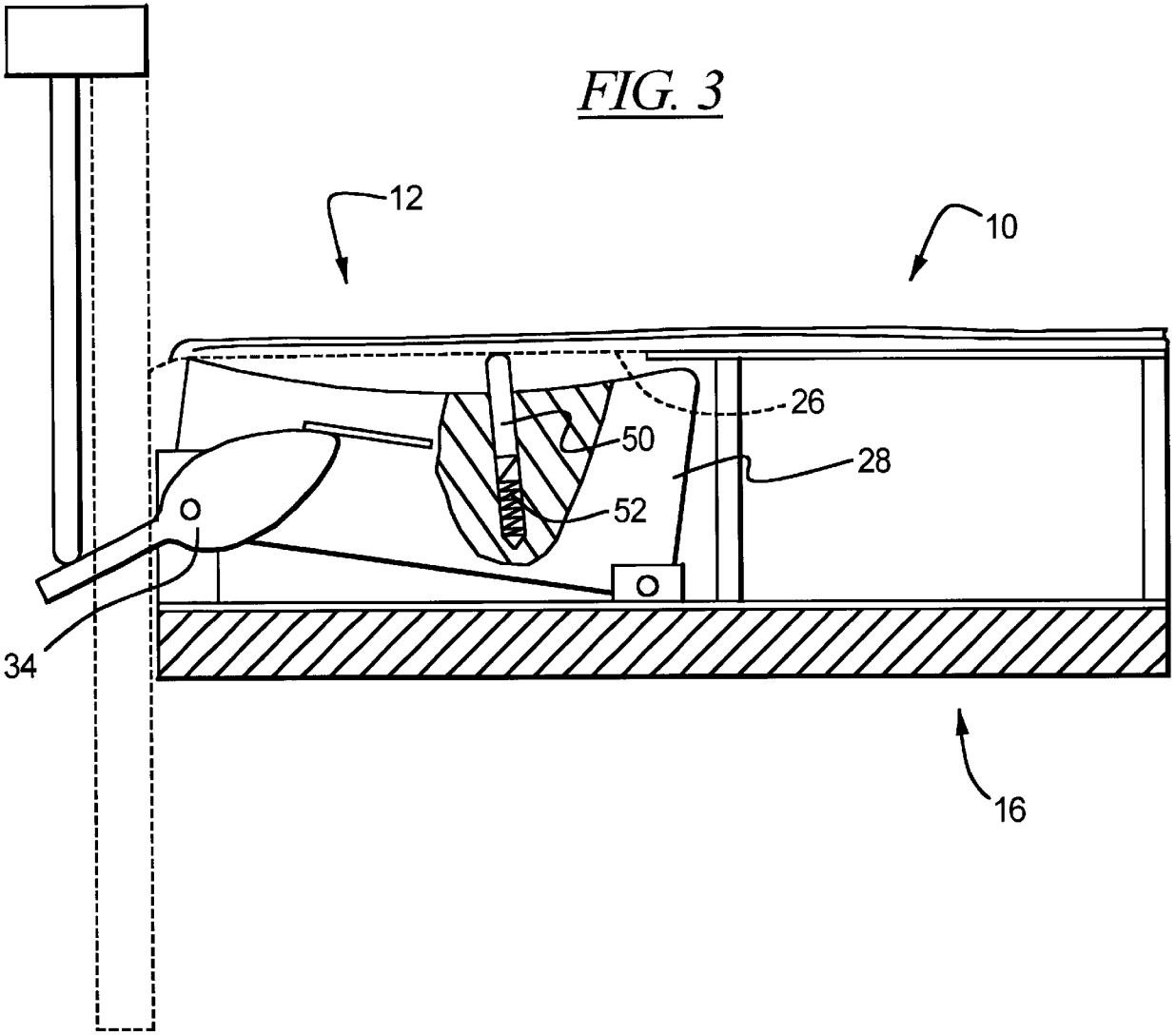
FIG. 3 shows a side sectional view paper supply device with an extended support element.

As further illustrated in FIG. 3, the stack 10 includes only a few single sheets. The lifting platform 16 is moved upwardly. The lever 34 is correspondingly swivelled in a large angle and pushes the bearing legs 28 upward. Due to the reduced weight of the stack 10 in the area 12, the support element 50 acts against the area 12 as a result of the spring force of the spring 52 and pushes the connected lamellae 26 upward, so that they almost lie in a plane. As a result, the single sheets also lie approximately in a plane and therefore are easily removed by the dispensing device. The lifting platform 16 moves downward again into a position shown in FIG. 1 when the last single sheet is removed and a new stack 10 of single sheets is placed again on the lifting platform of the paper supply device.

Figure 4:
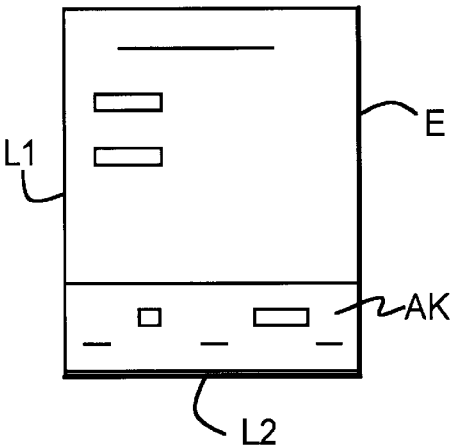
FIG. 4 shows a top view of a single sheet with a strip-shaped stick-on label.

FIG. 4 shows a single sheet E that is rectangular in shape, such as a DIN A4 shape. The single sheet also has a width L2 and a length L1. A stick-on label AK is attached to the single sheet in the strip region 12. The stick-on label has a width ranging from about 5 cm to about 7 cm. The thickness of the stick-on label AK approximately equals the thickness of the single sheet E. The single sheet E and the stick-on label AK are preferably preprinted and also preferably include fields in which data are printed during a subsequent printing.

The present invention is not limited to the exemplary embodiment shown in the FIGS. 1–6. For example, a rigid plate is provided instead of the interconnected lamellae 26 that are supported by the support element 50. In addition, the strip region 12 is not located in the margin of the single sheet but rather is located in the middle of the single sheets. In this case, the movable plate 22 or the lamellae 26 are also positioned at this location. Further, single sheets are removed by the dispense device in the longitudinal direction instead of the latitudinal direction.

Although modifications and changes may be suggested by those skilled in the art, it is the intention of the inventors to embody within the patent warranted hereon all changes and modifications as reasonably and properly come within the scope of their contribution to the art.

I claim as my invention:

1. A device and a stack for providing a supply of single sheets, comprising:

a plurality of single sheets forming a stack, each of said single sheets having a strip region and a non-strip region and a rectangular shape, said strip region having a strip region height and including a strip being attached to each of said single sheets, said strip extending along at least a portion of said sheet in a latitudinal direction, said non-strip region having a non-strip region height and being without said strip, said strip region height being greater than said non-strip region height;

said stack having an upper and lower single sheet, said upper single sheet being removable from said stack in said latitudinal direction;

a lifting platform contacting said stack, said lifting platform including:

a compensation device for leveling said upper single sheet by positioning said strip region height below said non-strip region height, said compensation device having:

a stationary plate and a movable plate, said stationary plate being positioned at said non-strip region, said movable plate being positioned at said strip region and a plurality of bearing legs rotatably mounted to support said movable plate;

a lever device rotatably mounted so as to lift said movable plate of said lifting platform, said
lever device including:
a lever arm having a lever arm side,
an eccentric disposed on said lever arm side, and
a dog element connected to said bearing legs,
said eccentric abutting against said dog element.

2. A device according to claim 1, wherein said device further comprises: a stationary detent mounted to said device, said lever arm pushes against said stationary detent.

3. A device according to claim 2, wherein said device further comprises: a printing system, said printing system includes said supply of said stack of single sheets and a lifting device and a paper dispensing device, said stack positioned on said lifting device, said lifting device moves said stack in an upward direction by pushing said lever arm against said detent so as to automatically level said stack, said leveled stack contacts said paper dispensing device mounted so as to remove said single sheets from said stack.

4. A device and a stack for providing a supply of single sheets, comprising:

a plurality of single sheets forming a stack, each of said single sheets having a strip region and a non-strip region and a rectangular shape, said strip region having a strip region height and including a strip being attached to each of said single sheets, said strip extending along at least a portion of said sheet in a latitudinal direction, said non-strip region having a non-strip region height and being without said strip, said strip region height being greater than said non-strip region height;

said stack having an upper and lower single sheet, said upper single sheet being removable from said stack in said latitudinal direction;

a lifting platform contacting said stack, said lifting platform including:

a compensation device for leveling said upper single sheet by positioning said strip region height below said non-strip region height, said compensation device having:

a stationary plate and a movable plate, said stationary plate being positioned at said non-strip region, said movable plate being positioned at said strip region said movable plate including lamellae, said lamellae being movably interconnected and extending in said latitudinal direction;

wherein said stack has a stack weight; and wherein a support element deflects said lamellae by pushing against said lamellae; said deflection of said lamellae varying with respect to said stack weight.

5. A device according to claim 4, wherein said support element includes a pressure spring.

6. A device and a stack for providing a supply of single sheets, comprising:

a plurality of single sheets forming a stack, each of said single sheets having a strip region and a non-strip region, said strip region having a strip region height and including a strip being attached to each of said single sheets, said strip extending along at least a portion of said sheet in a latitudinal direction said non-strip region having a non-strip region height and being without said strip, said strip region height being, greater than said non-strip region height;

said stack having an upper and lower single sheet, said upper single sheet being removable from said stack in said latitudinal direction;

a lifting platform contacting said stack, said lifting platform including:

a compensation device for leveling said upper single sheet by positioning said strip region height below said non-strip region height, said compensation device having:

a stationary plate and a movable plate, said stationary plate being positioned at said non-strip region, said movable plate being positioned at said strip region, and a plurality of bearing legs rotatably mounted to support said movable plate a lever device rotatably mounted so as to lift said movable plate of said lifting platform, said
lever device including:
a lever arm having a lever arm side,
an eccentric disposed on said lever arm side, and
a dog element connected to said bearing legs,
said eccentric abutting, against said dog element.

7. A device according to claim 6, wherein said device further comprises: a stationary detent mounted to said device, said lever aim pushes against a stationary detent.

8. A device according to claim 7, wherein said device further comprises: a printing system, said printing system includes said supply of said stack of single sheets and a lifting device and a paper dispensing device, said stack positioned on said lifting device, said lifting device moves said stack in an upward direction by pushing said lever arm against said detent so as to automatically level said stack, said leveled stack contacts said paper dispensing device mounted so as to remove said single sheets from said stack.

9. A device and a stack for providing a supply of single sheets, comprising:

a plurality of single sheets forming a stack, each of said single sheets having a strip region and a non-strip region, said strip region having a strip region height and including a strip being attached to each of said single sheets, said strip extending along at least a portion of said sheet in a latitudinal direction said non-strip region having a non-strip region height and being without said strip, said strip region height being greater than said non-strip region height;

said stack having an upper and lower single sheet, said upper single sheet being removable from said stack in said latitudinal direction;

a lifting, platform contacting said stack, said lifting, platform including:

a compensation device for leveling said upper single sheet by positioning said strip region height below said non-strip region height, said compensation device having:

a stationary plate and a movable plate, said stationary plate being positioned at said non-strip region, said movable plate being positioned at said strip region, said movable plate including a lamellae, each of said lamellae being movably interconnected and extending in said latitudinal direction;

wherein said stack has a stack weight, and wherein a support element deflects said lamellac by pushing against said lamellae, said deflection of said lamellae varying with respect to said stack weight.

10. A device according to claim 9, wherein said support element includes a pressure spring.

11. A method for providing a supply of single sheets, comprising the steps of:

forming a stack of a plurality of single sheets, each of said single sheets having a strip region and a non-strip region and a rectangular shape, said strip region having a strip region height and including a strip being attached to each of said single sheets extending along at least a portion of said sheet in a latitudinal direction, said non-strip region having a non-strip region height and being without said strip, said strip region height being greater than said non-strip region height;

placing said stack on a lifting platform, said stack having an upper and lower single sheet, said lifting platform including a compensation device;

leveling said stack with said compensation device by positioning said strip region height below said non-strip region height;

removing said upper single sheet from said stack in a latitudinal direction;

lifting said movable plate of said lifting platform by a lever device;

pushing said lever device against a stationary detent with a lever arm of said lever device;

providing a printing system, said printing system including said supply of said stack of single sheets and a lifting device and a paper dispensing device, said stack being positioned on said lifting device;

said lifting device moving said stack in an upward direction by pushing said lever arm against said detent so as to automatically level said stack; and said leveled stack contacting said paper dispensing device mounted so as to remove said single sheets from said stack.

12. A method for providing a supply of single sheets, comprising the steps of:

forming a stack of a plurality of single sheets, each of said single sheets having a strip region and a non-strip region and a rectangular shape, said strip region having a strip region height and including a strip being attached to each of said single sheets extending along at least a portion of said sheet in a latitudinal direction, said non-strip region having a non-strip region height and being without said strip, said strip region height being greater than said non-strip region height;

placing said stack on a lifting platform, said stack having an upper and lower single sheet, said lifting platform including a compensation device;

leveling said stack with said compensation device by positioning said strip region height below said non-strip region height;

removing said upper single sheet from said stack in a latitudinal direction;

lifting said movable plate of said lifting platform by a lever device; and pushing said lever device against a lamellae by a support element, said pushing varies with respect to a stack weight.

13. A method for providing a supply of single sheets, comprising the steps of:

forming a stack of a plurality of said single sheets, each of said single sheets having a strip region and a non-strip region and a rectangular shape said strip region having a strip region height and including a strip being attached to each of said single sheets, said non-strip region having a non-strip region height and being without said strip, said strip region height being greater than said non-strip region height;

placing said stack on a lifting platform, said stack having an upper and lower single sheet, said lifting platform including a compensation device;

leveling said stack with said compensation device by positioning said strip region height below said non-strip region height;

providing said lifting platform with a movable plate and a lifting device and lifting said movable plate with said lifting device;

providing said lifting device with a dog element and an eccentric and bearing legs; and pushing against said dog element with said eccentric;

wherein said dog element is connected to said bearing legs.

14. A method for providing a supply of single sheets, comprising the steps of:

forming a stack of a plurality of said single sheets, each of said single sheets having a strip region and a non-strip region and a rectangular shape said strip region having a strip region height and including a strip being attached to each of said single sheets, said non-strip region having a non-strip region height and being without said strip, said strip region height being greater than said non-strip region height;

placing said stack on a lifting platform, said stack having an upper and lower single sheet, said lifting platform including a compensation device;

leveling said stack with said compensation device by positioning said strip region height below said non-strip region height;

providing said lifting platform with a movable plate and a lifting device and lifting said movable plate with said lifting device;

providing a stationary detent and a lever arm; and pushing said movable plate by pushing said lever arm against said stationary detent.

15. A method according to claim 14, wherein said method further comprises the steps of: providing a printing system, said printing system includes said supply of said stack of single sheets and a lifting device and a paper dispensing device, said stack positioned on said lifting device, said lifting device moves said stack in an upward direction by pushing said lever arm against said detent so as to automatically level said stack, said leveled stack contacts said paper dispensing device mounted so as to remove said single sheets from said stack.

* * * * *